United States Patent [19]

Kikuchi et al.

[11] Patent Number: 4,478,181

[45] Date of Patent: Oct. 23, 1984

[54] AFTER GLOW CONTROL SYSTEM FOR ENGINE

[75] Inventors: Tetsuro Kikuchi, Aichi; Masanori Kato, Kariya; Masahiko Kato; Kazutaka Kato, both of Okazaki; Tomio Kumoi, Kariya, all of Japan

[73] Assignees: Nippon Soken, Inc., Nishio; Nippondenso Co., Ltd., Kariya, both of Japan

[21] Appl. No.: 437,171

[22] Filed: Oct. 27, 1982

[30] Foreign Application Priority Data

Oct. 27, 1981 [JP] Japan ..... 56-171604
Sep. 21, 1982 [JP] Japan ..... 57-165772

[51] Int. Cl.[3] ..... F02N 17/00

[52] U.S. Cl. ..... 123/145 A; 123/179 H; 123/179 BG; 219/492; 219/497

[58] Field of Search ..... 123/179 H, 179 B, 179 BG, 123/145 A; 219/494, 497, 508, 509, 202

[56] References Cited

U.S. PATENT DOCUMENTS 4,317,434 3/1982 Kato ..... 123/179 BG
4,350,876 9/1982 Kubofa et al. ..... 123/179 H
4,357,525 11/1982 Jenne ..... 219/508
4,375,205 3/1983 Green ..... 123/179 H

FOREIGN PATENT DOCUMENTS 158543 12/1979 Japan ..... 123/179 BG
112873 9/1980 Japan ..... 123/179 BG
85568 7/1981 Japan ..... 123/179 BG

*Primary Examiner*—Parshotam S. Lall
*Attorney, Agent, or Firm*—Cushman, Darby & Cushman

[57] ABSTRACT

An after glow control system for an engine, which controlls the voltage to be applied to glow plugs of the engine, is disclosed. The system comprises a first electric path through which a voltage is applied from a battery to glow plugs during the preheating period and a second electric path which is connected to the first electric path in parallel and through which a voltage is applied from the battery to the glow plugs during the after glow period. In the second electric path, a voltage dropping circuit of a switching type is provided. The voltage dropping circuit is provided with a switching means between the battery and the glow plugs and a switching control circuit which controls the opening and closing period of the switching means. The switching control circuit is provided with a set voltage generating circuit and a comparator which compares the output voltage of the voltage dropping circuit with the set voltage generated by the set voltage generating circuit and controls the opening and closing period of the switching means so as to keep the voltage to be applied to the glow plugs nearly equal to the set voltage. The set voltage generating circuit can be provided with a means for selecting a set voltage in accordance with the engine temperature.

16 Claims, 7 Drawing Figures

AFTER GLOW CONTROL SYSTEM FOR ENGINE

BACKGROUND OF THE INVENTION

The present invention relates to a system for controlling the voltage to be applied to glow plugs which are installed in an engine, especially a diesel engine.

In the diesel engine, just before the engine is started, a voltage is applied to the glow plugs for preheating the same. And after the engine is started, mainly during the warm-up period, a voltage is also applied to the glow plugs (which is called after glow) for preventing the vibrations and noise from occurring in the engine and reducing white smoke within the exhaust gases.

But, during the warm-up period, such a high voltage as to be required during the preheating period need not be applied to the glow plugs.

In particular, since heating elements of which rated voltage is smaller than the battery voltage are recently employed as the glow plugs in order to effect the preheating operation rapidly, excess voltage is applied to the glow plugs during the after glow period. As a result, the life of the glow plugs is decreased.

The amount of heat which is required to be generated by the glow plugs during the after glow period is related to the engine temperature.

When the engine is started, the temperature of engine rises. Due to the rise of engine temperature, the glow plugs also receive heat from the engine. Therefore, it is desirable to change the voltage to be applied to the glow plugs in accordance with the engine temperature during the after glow period.

Normally, one battery is mounted on a vehicle so that the voltage applied to the glow plugs is constant. Therefore, a voltage dropping means is required for dropping the voltage to be applied to the glow plugs during the after glow period.

Conventionally, it has been proposed to provide resistors in an electric path between the battery and the glow plugs. However, according to this conventional means, thermal loss occurs and a special structure is required in order to arrange the resistors which generates heat.

Accordingly, one object of the present invention is to provide an after glow control system for an engine, which can reduce the voltage to be applied to the glow plugs without thermal loss.

Another object of the present invention is to provide an after glow control system for an engine which can change the voltage to be applied to the glow plugs in accordance with the engine temperature during the after glow period.

DESCRIPTION OF THE DRAWINGS

Other objects and advantages of the invention will become apparent from the following description of embodiments thereof with reference to the accompanying drawings wherein.

SUMMARY OF THE INVENTION

The after glow control system of the present invention comprises a first electric path through which a voltage is applied from a battery to glow plugs during the preheating period and a second electric path which is connected to the first electric path in parallel and through which a voltage is applied from the battery to the glow plugs during the after glow period.

In the second electric path, a voltage dropping circuit of a switching type is provided. The voltage dropping circuit is provided with a switching means between the battery and the glow plugs, and a switching control circuit which controls the opening and closing period of the switching means.

The switching control circuit is provided with a set voltage generating circuit and a comparator which compares the output voltage of the voltage dropping circuit with the set voltage generated by the set voltage generating circuit and controls the opening and closing period of the switching means so as to keep the voltage to be applied to the glow plugs nearly equal to the set voltage.

The set voltage generating circuit can be provided with a means for selecting a set voltage in accordance with the engine temperature.

DETAILED DESCRIPTION OF THE INVENTION

Figure 1:
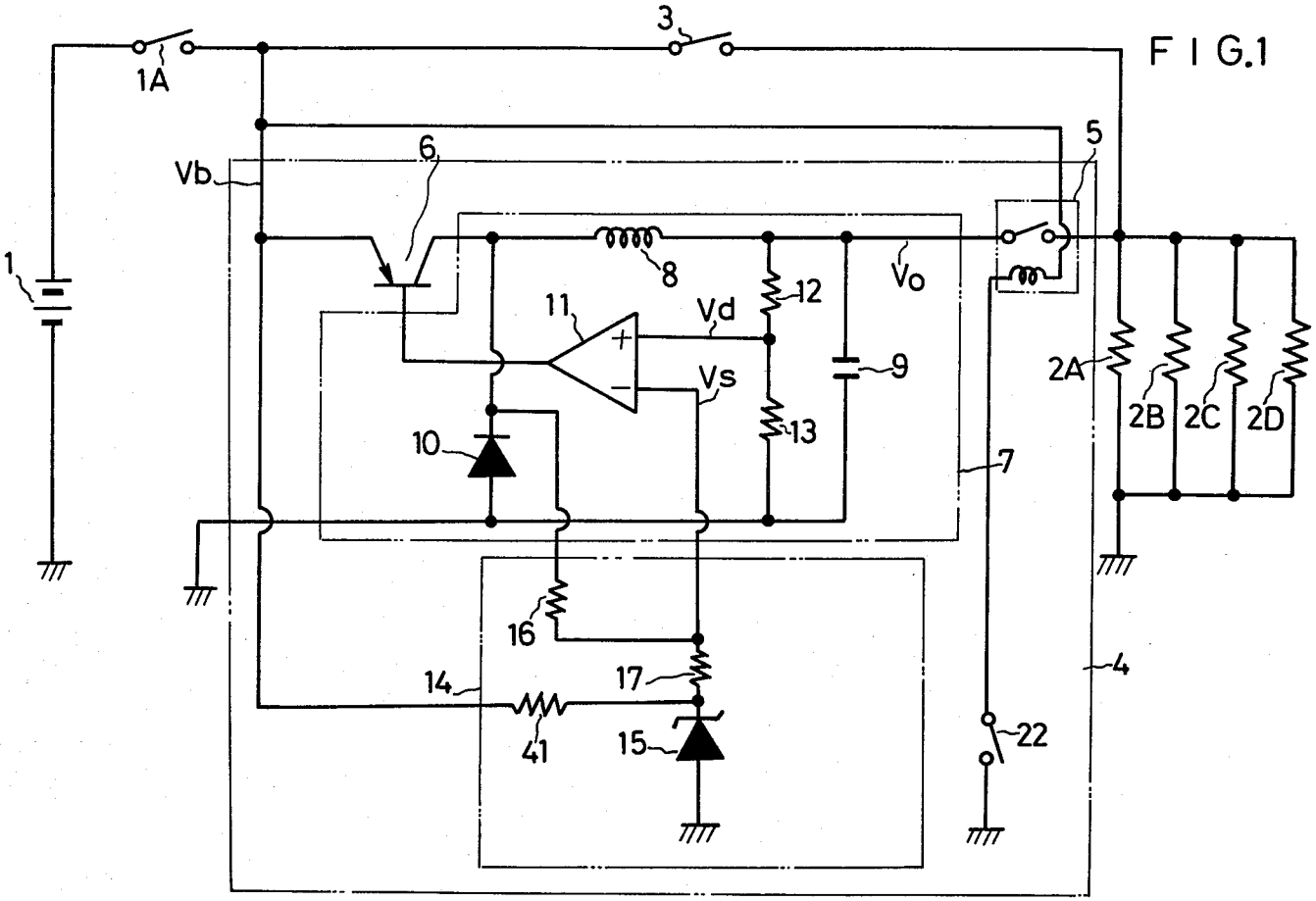
FIG. 1 is a circuit diagram illustrating a first embodiment of the after glow control system according to the present invention.

FIG. 1 illustrates a first embodiment of the after glow control system according to the present invention.

To both ends of a battery 1, a battery charger such as an alternator (not shown) which is driven by an engine (not shown), is connected. The battery 1 supplies an electric current to a load circuit through a main switch 1A.

Glow plugs 2A, 2B, 2C, 2D are connected in parallel and disposed within the cylinders of a four-cylinder diesel engine, respectively.

A switch 3 (hereinafter will be referred to as a preheating switch) is provided between the battery 1 and the glow plugs 2A to 2D, and is manually closed before the engine starts.

A voltage dropping circuit 4 for dropping the voltage which is to be applied to the glow plugs 2A to 2D is provided with an auxiliary switch 5 which is provided between the battery 1 and the glow plugs 2A to 2D. The voltage dropping circuit 4 is generally called a switching regulator. In FIG. 1, only main circuit elements are shown. The voltage dropping circuit 4 is provided with a switching transistor 6 which is positioned between the battery 1 and the glow plugs 2A to 2D.

The transistor 6 cuts off the voltage Vb applied by the battery 1 intermittently in cooperation with a switching control circuit 7 of the votage dropping circuit 4 to adjust the average value of the output voltage Vo of the switching control circuit 7 of the voltage dropping circuit 4. In the switching control circuit 7, a reactor 8 and a capacitor 9 compose a smoothing filter of a choke input type. A diode 10 acts the fly-wheel operation so that the energy stored in the reactor 8 is supplied to the load side even when the transistor 6 is in a non-conductive state.

The switching control circuit 7 is provided with a comparator 11 which compares the divided voltage Vd appearing at a juncture of voltage dividing resistors 12, 13 connected in parallel with the capacitor 9, with the set voltage Vs and switches the transistor 6 on and off in accordance with the result of this comparison. The output voltage Vo of the voltage dropping circuit 4 is simulated by the divided voltage Vd. Therefore, the desired value of the output voltage Vo can be arbitarily selected by changing the resistance ratio of the resistors 12, 13 or changing the set voltage Vs.

When the obtained output voltage Vo is smaller than the desired adjusting value thereof, the divided voltage Vd is lower than the set voltage Vs. At this time, at an output terminal of the comparator 11, a low level signal appears so that the transistor 6 of PNP type conducts to apply an electric current to the glow plugs 2A to 2D through the reactor 8.

When the output voltage Vo exceeds the desired value, the divided voltage Vd becomes higher than the set voltage Vs. At this time, at the output terminal of the comparator 11, a high level signal appears so that the transistor 6 is turned off. As a result, the electric energy which has been stored in the reactor 8 is supplied to the glow plugs 2A to 2D through the fly-wheel diode 10.

After the repitition of the above described steps, the output voltage Vo can be adjusted to a constant value nearly equal to the desired value though containing a small ripple voltage.

The transistor 6 is turned on and off at a predetermined frequency depending on the time constant which is determined by the reactor 8 and the capacitor 9.

In the system of the present invention, such a time constant is set so that the frequency ranges from several KHz to several tens KHz.

The set voltage Vs is generated in a set voltage generating circuit 14, in which a zenor diode 15 is connected to a load resistor 16 and a hysteresis setting resistor 17 in series. And the zenor diode 15 is provided between a resistor 41 and the ground earth.

The set voltage Vs appears at a juncture between the resistors 16, 17 and is equal to the sum of the break sown voltage VI of the zener diode 15 and the voltage drop occurring in the hysteresis setting resistor 17. The electric current passing the zener diode 15 pulsates by the action of the transistor 6.

Therefore, the set voltage Vs varies in accordance with the pulsation of the electric current, so that the hysteresis is applied to the comparator 11.

As the auxiliary switch 5, an electro-magnetic relay is used and the opening timing thereof is determined by a warm-up detecting switch 22. As the warm-up detecting switch 22, a temperature switch which opens when the temperature of the engine cooling water exceeds 60° C., is employed, for example.

Generally, the after glow operation is required during the warm-up period when the temperature of the engine is low and the number of revolutions of the engine is small. Therefore, the auxiliary switch 5 is kept closed during the warm-up period.

Figure 2:
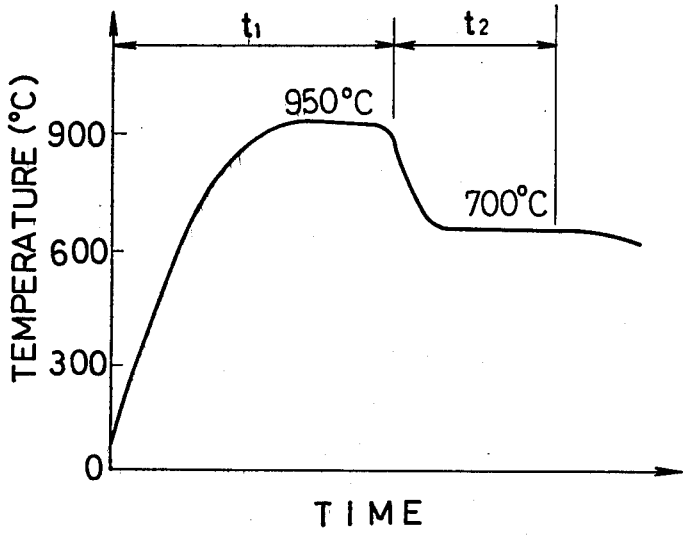
FIG. 2 is a graph showing the temperature change of the glow plugs which are controlled by the first embodiment of the after glow control system.

FIG. 2 shows the temperature change of the glow plugs 2A to 2D which are controlled by the after glow control system of the present invention.

In the period $t_1$, the main switch 1A and the preheating switch 3 are closed so that a battery voltage is directly applied to the glow plugs 2A to 2D from the battery 1. As a result, the temperature of each glow plug rises. The battery voltage is set so as to maintain the temperature of each glow plug at 950° C.

Next, the engine is started, and then the preheating switch 3 is opened.

In the period $t_2$ when the engine is already started, the voltage dropping circuit 4 controls the voltage Vo to be applied to the glow plugs 2A to 2D.

A set voltage to be applied to the switching control circuit 7 is determined by the zener diode 15. By the voltage Vo which is applied to the glow plugs 2A to 2D from the voltage dropping circuit 4 through the auxiliary switch 5, the temperature of each glow plug is maintained at about 700° C.

When the temperature of engine rises and the warm-up detecting switch 22 opens, the auxiliary switch 5 is opened to cut off the supply of electric current to the glow plugs 2A to 2D.

As the warm-up detecting switching 22, a detecting circuit which detects the timing when the engine speed reaches a predetermined speed or the running speed of the vehicle driven by this engine reaches a predetermined speed, a detecting switch which detects the timing when the pressing amount of the accelerator pedal reaches a predetermined value or the like can be used solely or in combination.

For example, it is possible to use the accelerator pedal detecting switch together with the temperature switch 22 by connecting them in series. In this case, the auxiliary switch 5 is opened when the pressing amount of the accelerator pedal reaches a predetermined value, even if the temperature of engine is low.

Therefore, in this case, the electric current is intermittently supplied to the glow plugs 2A to 2D in accordance with the engine operating condition.

Figure 3:
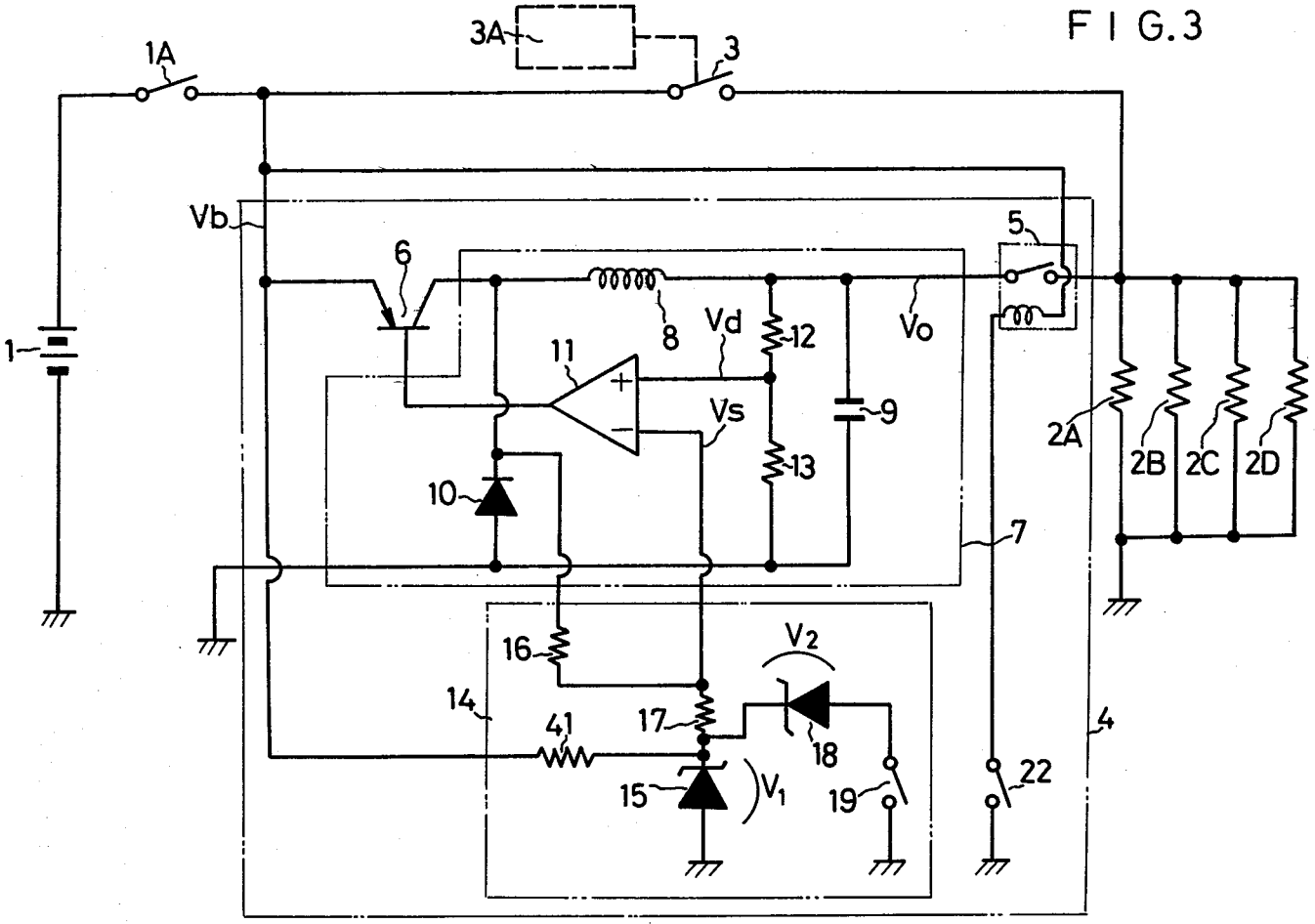
FIG. 3 is a circuit diagram illustrating a second embodiment of the after glow control system according to the present invention.

FIG. 3 illustrates a second embodiment of the after glow system according to the present invention.

According to the second embodiment, an on-off temperature controller 3A can be used for opening and closing intermittently the preheating switch 3. As the on-off temperature controller, the conventional one can be employed. And the set voltage generating circuit 14 is provided with a means for changing the set voltage Vs in response to the temperature of the engine cooling water.

The other structure of the second embodiment is substantially equal to that of the first embodiment.

By controlling the preheating switch 3 by means of the on-off temperature controller, the rated voltage of the glow plugs can be made about one half of the battery voltage. Therefore, the glow plugs 2A to 2D are rapidly heated to a predetermined temperature, and the temperature of the glow plugs is maintained.

In the set voltage generating circuit 14, a series circuit composed of a second zener diode 18 and a temperature switch 19, is connected to a first diode 15 in parallel. The temperature switch 19 is disposed in a water jacket and closes its normally-opened contact when the temperature of the cooling water exceeds 20° C., for example. The breakdown voltage $V_2$ of the second zener diode 18 is set to the value smaller than that of the first zener diode 15.

Therefore, the set voltage Vs is determined by the first zener diode 15 when the temperature of the engine is low. When the temperature of the engine rises to a predetermined temperature (20° C.), the set voltage Vs is changed to the value which is determined by the second zener diode 18. As a result, the output voltage Vo of the voltage drop circuit 4 is decreased by two stages as the temperature of engine rises.

In the second embodiment, the set voltage Vs which changes by two stages is set so that the output voltage Vo is three fourth and one half of the rated voltage of the glow plugs 2A to 2D, respectively.

Figure 4:
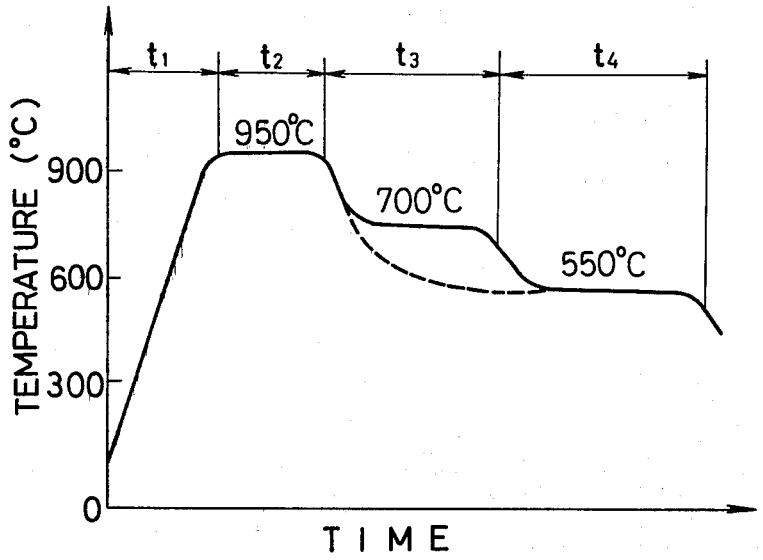
FIG. 4 is a graph showing the temperature change of the glow plugs which are controlled by the second embodiment of the after glow control system.

FIG. 4 shows the temperature change of the glow plugs 2A to 2D which are controlled by the after glow control system of the second embodiment. In the period $t_1$, the main switch 1A and the preheating switch 3 are closed so that the battery voltage larger than the rated voltage of each glow plug is directly applied to each glow plug from the battery 1.

As a result, the temperature of the glow plugs rapidly rises. In 3 to 5 seconds, the temperature of the glow plugs reaches a predetermined upper limit temperature of 950° C.

When the temperature of engine is lower than 60° C., the auxiliary switch 5 is closed. The output voltage of the voltage dropping circuit 4 is the same potential with the input voltage thereof. The transistor 6 remains non-conductive.

In the period $t_2$, the preheating switch 3 is opened or closed by the on-off temperature controller 3A. In this period, to the glow plugs 2A to 2D, the voltage of the battery 1 is intermittently applied so that the temperature of each glow plug is maintained at about 950° C. When the engine is started, the preheating switch 3 is opened.

After the period $t_2$, the voltage dropping circuit 4 controls the voltage Vo to be applied to the glow plugs 2A to 2D. In the period $t_3$ wherein the temperature of the engine cooling water is below 20° C., the temperature switch 19 is kept open. In this period, the set voltage Vs of the switching control circuit 7 is determined by the first zener diode 15. To each glow plug, the voltage Vo which is three fouth of the rated voltage of the glow plugs 2A to 2D is applied from the voltage dropping circuit 4 through the auxiliary switch 5. As a result, the temperature of each glow plug is maintained at about 700° C.

In the period $t_4$ wherein the temperature of the engine cooling water rises above 20° C., the temperature switch 19 is closed. In this period, the set voltage Vs of the switching control circuit 7 is determined by the second zener diode 18 so that the output voltage Vo of the voltage dropping circuit 4 is reduced to one half of the rated voltage of the glow plugs 2A to 2D. As a result, the temperature of the glow plugs 2A to 2D is maintained at about 550° C.

When the engine temperature rises furthermore, for example above 60° C., the warm-up detecting switch 22 is opned so that the auxiliary switch 5 is opened. As a result, the electric supply to the glow plugs 2A to 2D is stopped.

If the engine temperature rises to such a temperature as to close the temperature switch 19 when the engine is started, the voltage dropping circuit 4 operates to reduce the output voltage Vo to one half of the rated voltage of the glow plugs 2A to 2D even in the period $t_3$ as shown by a broken line in FIG. 4.

Figure 5:
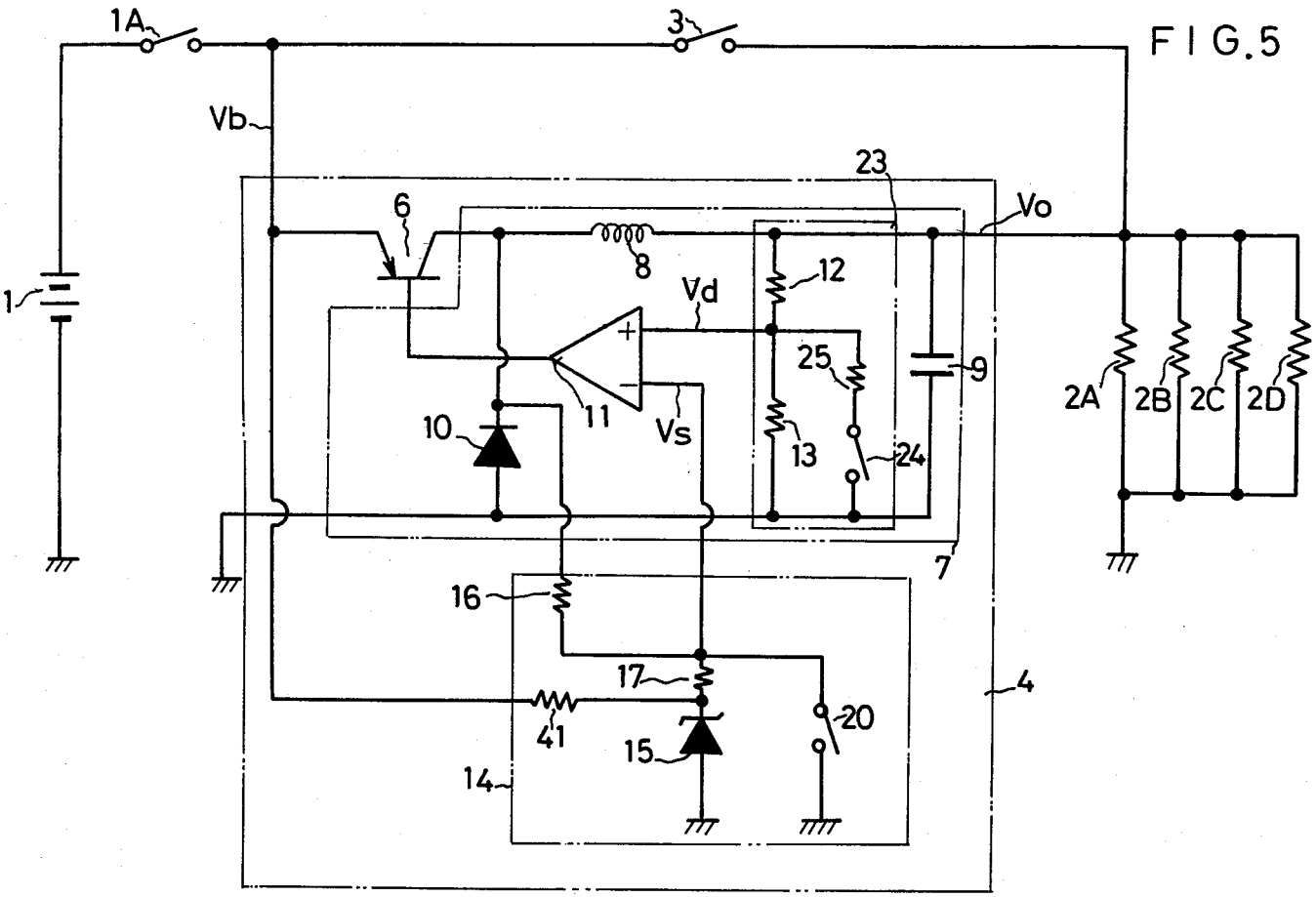
FIG. 5 is a circuit diagram illustrating a third embodiment of the after glow control system according to the present invention.

FIG. 5 illustrates a third embodiment of the present invention.

In the third embodiment, the output voltage Vo of the voltage dropping circuit 4 is controlled by a voltage dividing circuit 23. The voltage dividing circuit 23 is provided with a series circuit composed of a temperature switch 24 and a reistor 25. This series circuit is connected to the juncture between the voltage dividing resistors 12 and 13. The temperature switch 24 responds to the temperature of the engine cooling water. Namely, the temperature switch 24 is closed when the temperature of the engine cooling water is below 20° C., and is opened when the temperature of the engine cooling water exceeds 20° C. The divided voltage Vd obtained when the temperature switch 24 is opened is higher than that obtained when the temperature switch 24 is closed. And when the temperature switch 24 is closed, the output voltage Vo becomes higher than that when the temperature switch 24 is opened.

In the third embodiment, such an auxiliary switch as shown in the second embodiment is not used between the voltage dropping circuit 4 and the glow plugs 2A to 2D. In place of the auxiliary switch, an electric current breaking switch 20 is connected to the set voltage generating circuit 14. The breakig switch 20 is opened during the warming up period and is closed during the other period.

The breaking switch 20 may have substantially the same structure as that of the warm-up detecting switch 22 shown in the second embodiment. In the end of the warming up period or when the accelerator pedal is pressed to some degree, the breaking switch 20 is closed so that the set voltage Vs becomes 0 volt.

Then, the switching control circuit 7 operates to maintain the output voltage Vo to the minimum level. As a result, the transistor 6 is controlled to the off state.

Figure 6:
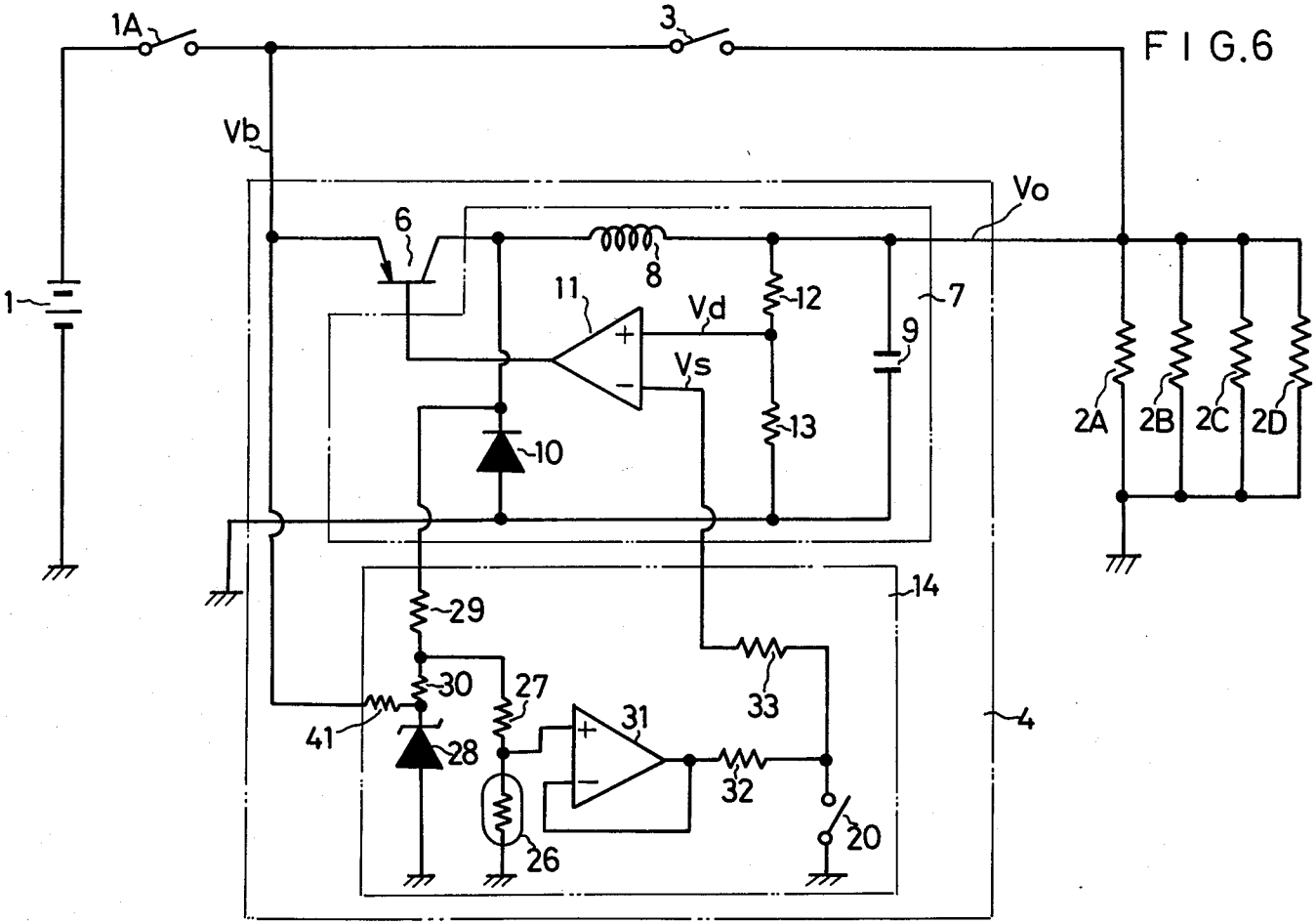
FIG. 6 is a circuit diagram illustrating a fourth embodiment of the after glow control system according to the present invention.

FIG. 6 illustrates a fourth embodiment of the present invention. In the fourth embodiment, the set voltage generating circuit 14 continuously varies the set voltage Vs in accordance with the engine temperature so that the output voltage Vo to be applied to the glow plugs 2A to 2D is gradually reduced as the engine temperature rises.

A thermister 26 is provided in such a position as to detect the engine temperature and is connected to a zener diode 28 through a resistor 27.

The reference numeral 29 designates a load resistor of the zener diode 28 and 30 designates a hysteresis setting resistor. In the juncture between the thermister 26 and the resistor 27, a voltage signal which drops as the engine temperature rises, appears. This voltage signal is applied to the comparator 11 through an impedance converter 31, and resistors 32, 33. In the fourth embodiment, the breaking switch 20 operates in the same manner as that of the third embodiment.

Figure 7:
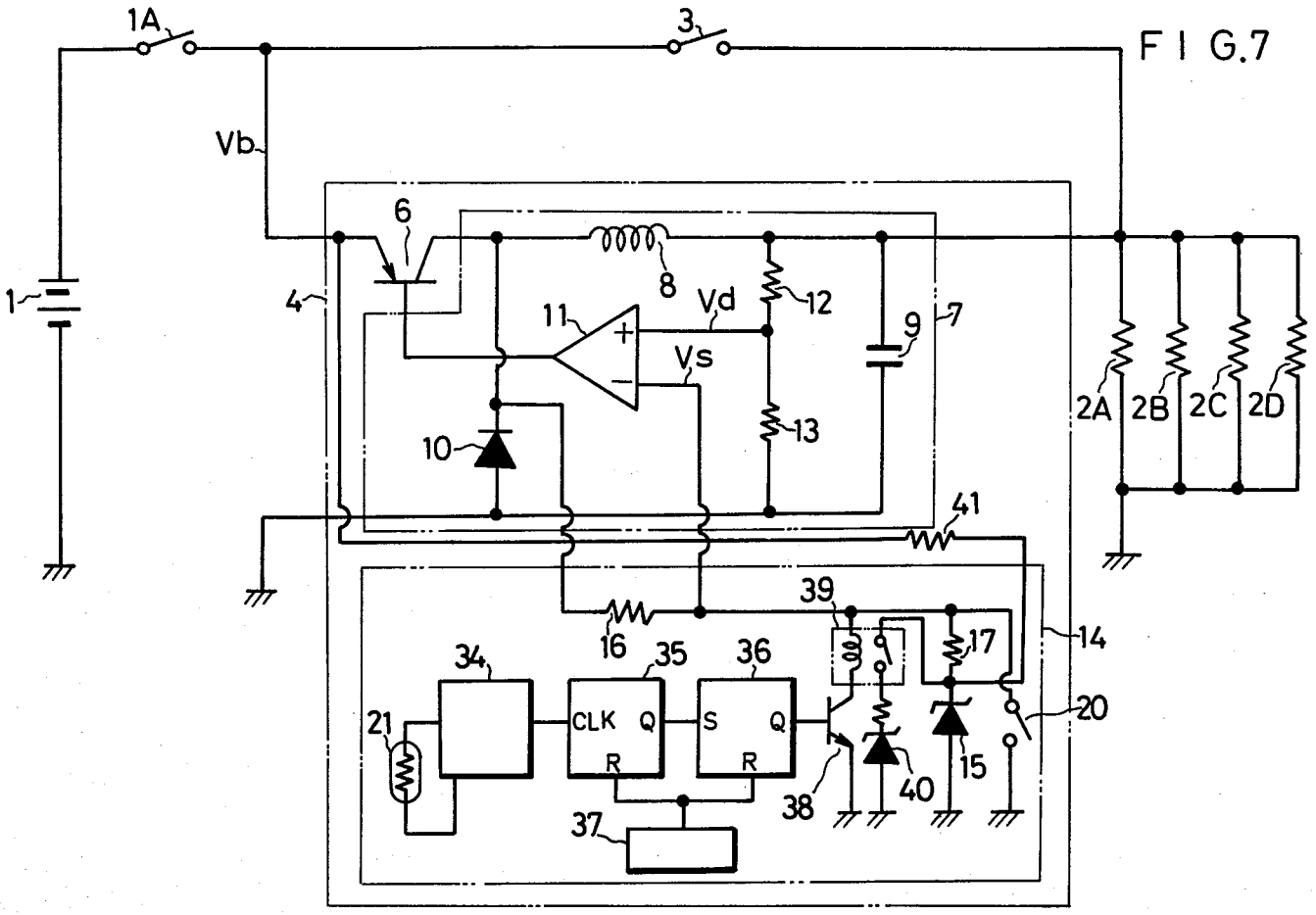
FIG. 7 is a circuit diagram illustrating a fifth embodiment of the after glow control system according to the present invention.

FIG. 7 illustrates a fifth embodiment of the present invention. In the fifth embodiment, the set voltage generating circuit 14 changes the set voltage Vs by two stages like the second embodiment. According to the fifth embodiment, the timing when the set voltage Vs is changed from the first stage to the second low stage, continuously varies in accordance with the engine temperature.

In the set voltage generating circuit 14, an oscillation circuit 34 is a well known CR oscillation circuit.

A thermister 21 is used in place of one of the resistors of the oscillation circuit 34, for detecting the engine temperature. As the engine temperature rises, the oscillation frequency of the oscillation circuit 34 is increased. The output pulse signal of the oscillation circuit 34 is counted up by a pulse counter 35. When the counting number of the pulse counter 35 reaches a predetermined value, a high level signal appears in the output terminal Q. This high level signal is applied to a set terminal S of a flip-flop 36.

The pulse counter 35 and the flip-flop 36 are reset just before the engine starting time by a reset circuit 37 which generates a reset pulse in response to the starting operation of the engine.

When the pulse counter 35 counts up a predetermined number of pulses after the engine is started, the flip-flop 36 is set by a count up signal of the counter 35.

A transistor 38 connected to the output terminal Q of the flip-flop 36 is turned on in response to the high level output signal of the flip-flop 36 and closes the contact of an electromagnetic relay 39. The contact of the electromagnetic relay 39 is connected to a second zener diode 40 in series, and is connected to a first zener diode 15 in parallel like the second embodiment. The breakdown voltage of the second zener diode 40 is set to the value smaller than that of the first zener diode 15.

When the preheating switch 3 is opened after the engine starting operation, a set voltage which is determined by the first zener diode 15, is applied to the comparator 11. When the pulse counter 35 counts up a predetermined pulse number, the set voltage Vs is changed to the smaller value determined by the second zener diode 40.

The oscillation frequency of the oscillation circuit 34 and the above described predetermined pulse number of the pulse counter 35 are determined so that when the temperature of the engine cooling water is 30° C., three minutes of warm-up period can be obtained. When the temperature of the cooling water is lower than 30° C., the warm-up period becomes longer than three minutes. As the temperature of the cooling water gradually rises, the warm-up period is gradually reduced.

Namely, the warm-up period is determined in accordance with the average engine temperature at the pulse counting time.

The present invention has been explained in accordance with the representative embodiments with reference to the drawings. The present invention is not limited to these embodiments. Modification thereof is possible.

For example, in the above described embodiments, the electric current is applied to the glow plugs 2A to 2D through the series circuit composed of the main switch 1A and the preheating switch 3 for preheating the engine before the engine is started.

In place of the above described series circuit, other well known circuit can be used.

In the period $t_2$ shown in FIG. 4, the voltage dropping circuit 4 can substitute for the preheating switch 3. Namely, when the rated voltage of the glow plugs 2A to 2D is lower than the voltage of the battery 1, the voltage dropping circuit 4 can apply such a rated voltage to the glow plugs 2A to 2D in the period $t_2$.

The output voltage of the voltage dropping circuit 4 can be controlled by the switching control circuit 7 so as to change by more than three steps other than two steps.

In the above embodiment, the voltage dropping circuit 4 is stopped by applying zero volt as the set voltage, to the comparator 11 so as to generate such a high level signal as to turn the transistor 6 off, at the output terminal.

In place of this method, such a circuit as to keep the input signal for the transistor 6 to a such a high level as to turn the trasistor 6 off in accordance with the operation of the breaking switch (warm-up detecting switch), can be provided on the input side of the transistor 6.

When the system of the present invention is installed in a vehicle, it is preferable to connect well known noise filters to the input terminal and the output terminal of the voltage dropping circuit 4.

As described above, according to the present invention the voltage dropping circuit of a switching type is adopted to control the average output voltage in accordance with the engine temperature. Therefore, a proper amount of electric power corresponding to the engine temperature can be supplied and heat loss is small so that the power saving effect can be obtained.

Having now fully described the invention, it will be apparent to one of ordinary skill in the art that many changes and modifications can be made thereto without departing from the spirit or scope of the invention as set forth herein.

What is claimed is:

1. An after glow control system for applying a voltage to glow plugs installed in an engine of a vehicle, comprising:

a battery mounted on said vehicle;

a plurality of glow plugs provided in combustion chambers of said engine;

a first electric path for connecting said battery and said glow plugs through a switch;

a second electric path which is connected to said first electic path in parallel, for connecting said battery and said glow plugs through a voltage dropping circuit of which operation starts when said first electric path is cut off and stops when the engine temperature reaches a predetermined temperature;

said voltage dropping circuit being composed of a switching means provided between said battery and said glow plugs, a switching control circuit for controlling the opening and closing period of said switch and a set voltage generating circuit for generating a set voltage;

said switching control circuit being composed of an output feedback circuit for feedbacking said output voltage of said voltage dropping circuit, and a comparator for comparing said feed-backed output voltage with said set voltage to apply an electric signal to said switch.

2. An after glow control system according to claim 1, further comprising:

a smoothing circuit for smoothing an output voltage of said voltage dropping circuit, which is provided between said switch and said glow plugs.

3. An after glow control system according to claim 1, wherein:

said switch provided in said first electric path is closed when said glow plugs are preheated and is opened when said engine is started.

4. An after glow control system according to claim 1, wherein:

said switch provided in said first electric path is operated in response to the change of engine temperature when said glow plugs are preheated; said switch is closed when the temperature of said glow plugs is not higher than a predetermined temperature and is opened when the temperature of said glow plugs is higher than a predetermined temperature.

5. An after glow control system according to claim 1, wherein:

said set voltage generating circuit is provided with a plurality of constant voltage sources having constant voltage respectively, which is different from each other, one of which is selected in accordance with the engine temperature.

6. An after glow control system according to claim 5, wherein:

said constant voltage sources are connected to temperature switches which are closed at a predetermined engine temperature, respectively to form series circuits; and said series circuits are connected to one another in parallel:

whereby said temperature switches continuously select one series circuit out of said series circuits in the order from one of which generating voltage is low to one of which generating voltage is high, in accordance with the rise of the engine temperature and apply set voltage to said comparator.

7. An after glow control system according to claim 6, wherein:

said constant voltage sources comprise a first zener diode having a predetermined breakdown voltage, and at least one second zener diode having a predetermined breakdown voltage lower than that of said first zener diode;

said zener diodes are connected to one another in parallel; and said at least one second zener diode is connected to said temperature switch which is closed at a predetermined engine temperature in series;

whereby said first zener diode applies a predetermined breakdown voltage to said comparator when said voltage dropping circuit starts operation; and said temperature switch selects at least one second zener diode and the selected second zener diode applies a predetermined breakdown voltage to said comparator in accordance with the temperature change of said engine after the engine temperature reaches a predetermined temperature.

8. An after glow control system according to claim 5, wherein:

said constant voltage sources are connected to temperature switches which are opened when said voltage dropping circuit starts operation, respectively, to form a series circuit;

the opening period of each of said temperature switches continuously changes in accordance with the average engine temperature;

said series circuits are connected to one another in parallel;

whereby said temperature switches continuously select one series circuit out of said series circuits in the order from one of which generating voltage is low to one of which generating voltage is high, in accordance with the rise of the engine temperature and apply set voltage to said comparator.

9. An after glow control system according to claim 8, wherein:

said constant voltage sources comprise a first zener diode having a predetermined breakdown voltage; and at least one second zener diode having a predetermined breakdown voltage lower than that of said first zener diode;

said zener diodes are connected to one another in parallel; and said at least one second zener diode is connected to said temperature switch.

10. An after glow control system according to claim 9, wherein:

said set voltage generating circuit is further provided with an oscillating circuit for generating a pulse signal having oscillation frequency increasing in accordance with the rise of engine temperature, and a pulse counter for counting up said pulse signal of said oscillating circuit and generating a count up signal;

whereby said temperature switch is closed by said count up signal.

11. An after glow control system according to claim 1, wherein:

said set voltage generating circuit is provided with a voltage source of which voltage continuously increases in accordance with the rise of engine temperature.

12. An after glow control system according to claim 11, wherein:

said voltage source is provided with a zener diode, and a voltage dividing circuit composed of two resistors which are connected in series; said voltage dividing circuit is connected to said zener diode in parallel;

one of said two resistors is composed of a thermister of which resistivity changes in accordance with the temperature change of said engine;

whereby the output voltage of said voltage dividing circuit is applied to said comparator as a set voltage.

13. An after glow control system according to claim 1, wherein:

said feedback circuit is provided with a means for changing the output voltage of said voltage dropping circuit by a predetermined constant ratio and supplying the changed output voltage to said comparator.

14. An after glow control system according to claim 1, wherein:

said feedback circuit is provided with a means for changing the output voltage of said voltage dropping circuit by the ratio determined by the temperature of said engine and applying said changed output voltage to said comparator.

15. An after glow control system according to claim 1, wherein:

said voltage dropping circuit is provided with a switching means on the output portion thereof; said switching means is closed when the temperature of said engine reaches a predetermined temperature to stop the operation of said voltage dropping circuit.

16. An after glow control system according to claim 1, wherein:

said set voltage generating circuit is provided with a means for decreasing said set voltage to 0 volt when the temperature of said engine reaches a predetermined temperature.

* * * * *